US005919085A

United States Patent [19]

Izumisawa

[11] Patent Number: 5,919,085

[45] Date of Patent: Jul. 6, 1999

[54] POWER ABRADING TOOL HAVING DUST ABATEMENT FEATURE

[75] Inventor: Osamu Izumisawa, Tokyo, Japan

[73] Assignee: S.P. Air Kabusiki Kaisha, Tokyo, Japan

[21] Appl. No.: 08/840,563

[22] Filed: Apr. 2, 1997

[30] Foreign Application Priority Data

Apr. 2, 1996 [JP] Japan ..... 08-080143

[51] Int. Cl.[6] ..... B24B 23/04; B24B 23/02

[52] U.S. Cl. ..... 451/357; 451/356; 451/359; 451/456

[58] Field of Search ..... 451/344, 351, 451/352, 353, 356, 358, 359, 451, 456, 357

[56] References Cited

U.S. PATENT DOCUMENTS

| | | | |
|---|---|---|---|
| 3,665,651 | 5/1972 | Wylde | 451/323 |
| 3,782,042 | 1/1974 | Strasbaugh | 451/390 X |
| 3,907,257 | 9/1975 | Drzewiecki | 451/358 |
| 4,302,910 | 12/1981 | Tschacher | 451/456 X |
| 4,671,019 | 6/1987 | Hutchins | 451/456 X |
| 4,839,995 | 6/1989 | Hutchins . | |
| 5,105,585 | 4/1992 | Hampl et al. | 451/456 X |
| 5,228,244 | 7/1993 | Chu | 451/456 |
| 5,292,352 | 3/1994 | Rudolf et al. . | |
| 5,441,450 | 8/1995 | Fein et al. . | |
| 5,445,558 | 8/1995 | Hutchins | 451/456 X |
| 5,482,499 | 1/1996 | Satoh | 451/356 |
| 5,531,639 | 7/1996 | Catalfamo | 451/456 |
| 5,595,530 | 1/1997 | Heidelberger | 451/356 |
| 5,681,213 | 10/1997 | Hashil | 451/351 X |

FOREIGN PATENT DOCUMENTS

| | | |
|---|---|---|
| 0 372 376 | 11/1989 | European Pat. Off. . |
| WO 94/04312 | 3/1994 | WIPO . |

*Primary Examiner*—Timothy V. Eley
*Attorney, Agent, or Firm*—Senniger, Powers, Leavitt & Roedel

[57] ABSTRACT

An abrading tool uses oscillatory motion to achieve abrading, such as for polishing or grinding operations. The abrading tool has a spindle capable of mounting an abrading pad. A motor of the tool has an output shaft and a cam unit on the output shaft which is partially received in a cam follower mounted on the spindle produces the oscillating motion. A self-aligning bearing interconnects the cam unit and cam follower to reduce vibration and noise. The tool has a pneumatic motor and exhaust air from the motor is used to aspirate dust generated by the tool in operation.

10 Claims, 5 Drawing Sheets

POWER ABRADING TOOL HAVING DUST ABATEMENT FEATURE

BACKGROUND OF THE INVENTION

This invention relates generally to power tools and more specific to a power abrading tool having particular application for polishing and grinding.

Power abrading tools of the type to which the present invention generally relates are used, for example, in sheet metal repair work for automobiles, grinding the surface of metal dies and surface polishing or grinding of other materials. Typically, these tools are hand held. In the past, abrading tools of this type have rotated an abrading pad mounted on the tool in one direction about an axis to polish or grind a surface contacted by the abrading pad. However, it has been found that continuous rotation of the abrading pad leaves marks on the surface being abraded. In order to achieve the best results, the abrading pad is rotated at high speed, causing substantial vibration of the tool. Vibrations of this type present the risk that an operator who uses the tool frequently and for long periods of time could develop pseudo-Raynaud's disease (a vibration syndrome occurring, for example, in users of chain saws and other equipment tending to vibrate in operation).

Japanese patent disclosure Hei 7-55162 discloses an abrading tool which converts rotational motion of its motor into reciprocating motion of the abrading pad to improve the quality of the polishing or grinding done by the tool. Reciprocating motion is achieved by linkage including a master gear and multiple gear racks. Thus, all of the force supplied by the motor is transmitted to the abrading pad through the intermeshing of gears. As a result, the teeth of the gears and gear racks are subjected to large loads, and experience wear and fatigue. Therefore, the tool has a relatively short operating life before repair or replacement will be required. In addition, high-precision machining of the gear tooth surfaces are required if the gear teeth are to mesh correctly, which makes the tools complicated and expensive.

In the normal operation of an abrading tool, substantial quantities of particulates from the surface along with fine abrasive dust from the abrasive material on the abrading pad are generated and become airborne. The particulates and dust gets into the eyes of the operator and can also be inhaled. Thus, use of the abrading tool can create an unhealthy work environment.

SUMMARY OF THE INVENTION

An object of this invention is to solve the problems described above, both making it possible to simplify the structure with which the rotational force from the motor is transmitted to the abrading pad, and making it possible to obtain a product with superior durability at a lower price. It is also an object of this invention to produce a better finish on the abraded surface, without grind marks. Still another object of the present invention is to safely collect the particulates and dust generated by the contact between the abrasive material of the abrading pad and the surface being abraded, thus improving the working environment.

Generally, a power abrading tool for use in polishing, grinding and the like comprises a housing, and a motor disposed in the housing and including an output shaft mounted for rotation about its longitudinal axis. A spindle supported by the housing for turning about its longitudinal axis is constructed for mounting an abrading pad thereon for conjoint movement with the spindle. A cam unit connected to the output shaft for rotation with the output shaft is eccentric of the output shaft for orbiting the axis of the output shaft upon rotation of the output shaft. A cam follower is mounted on the spindle for conjoint movement therewith and engages the cam unit whereby upon rotation of the output shaft the cam follower oscillates through an angle less than 360° about the longitudinal axis of the spindle and the spindle turns back and forth about its axis through the same angle.

In another aspect of the invention, a pneumatic abrading tool comprising a housing, and a motor disposed in the housing and including an output shaft mounted for rotation about its longitudinal axis. A spindle supported by the housing for turning about its longitudinal axis is constructed for mounting an abrading pad thereon for conjoint movement with the spindle. A connector on the housing is adapted for connection to a source of pressurized air, and passaging means in the housing is capable of communicating pressurized air from the connector through a valve to the motor. The motor comprises a rotor having vanes mounted on the output shaft for rotation of the shaft upon actuation of the valve to admit air into the motor. The passaging means includes an exhaust duct for receiving air exhausted from the motor, and an aperture is disposed for aspirating dust generated by operation of the tool into the exhaust duct.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
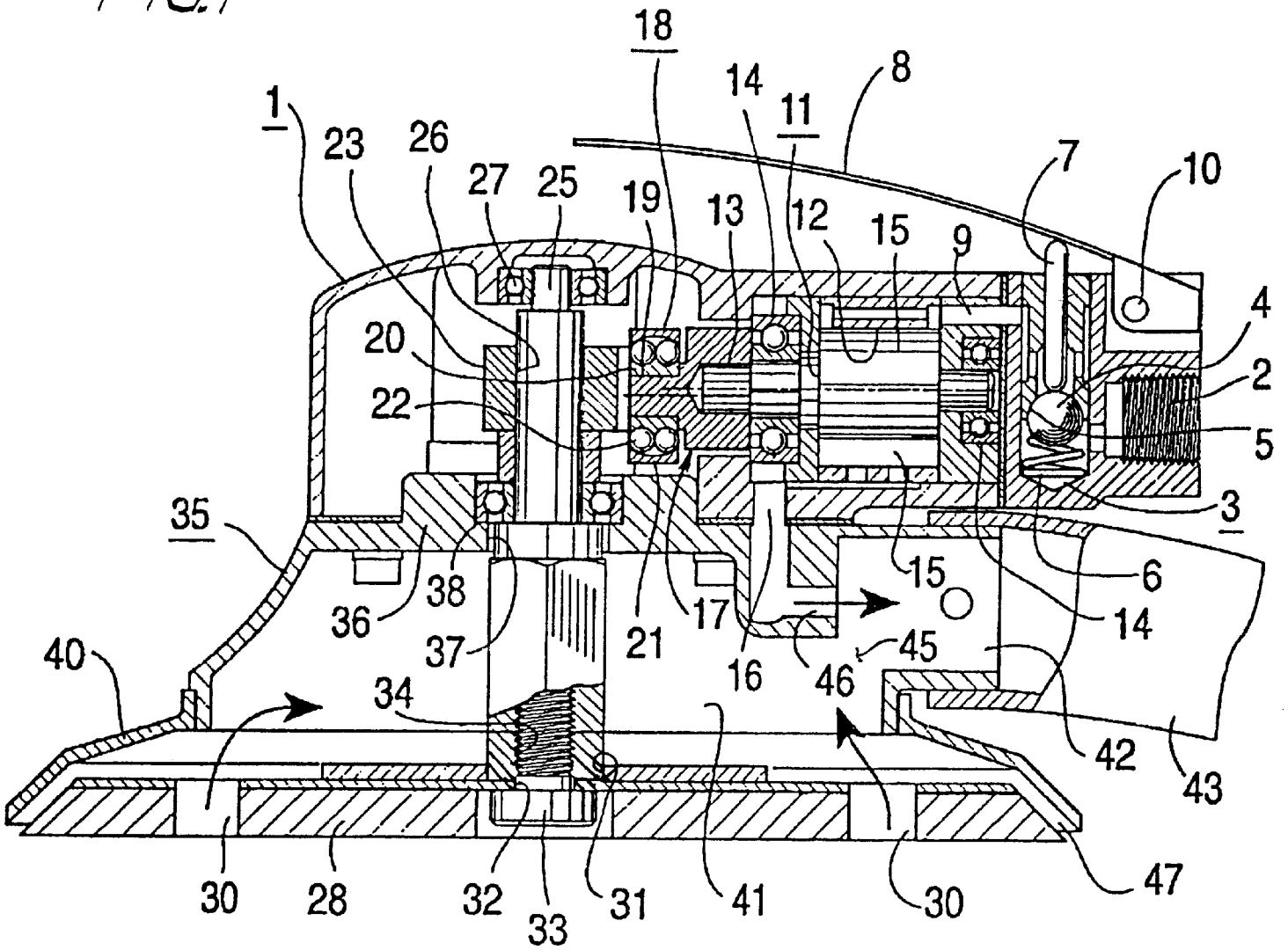
FIG. 1 is a vertical section of an abrading tool of the present invention.

Referring now to the drawings, and in particular to FIG. 1 an abrading tool constructed according to the principles of the present invention is shown to comprise a housing including an upper housing member 1 located generally at the top of the abrading tool. An intake 2 is formed in the housing and has internal threads (broadly, "a connector") formed therein for connecting the tool to a supply of pressurized air, such as an air compressor (not shown). Downstream of the intake 2 in the housing is a valve, generally indicated at 3, including a ball 4, a valve seat 5 and a coil spring 6. The ball 4 is urged by the spring 6 against the valve seat 5 to close the valve and prevent passage of air through the valve (as is shown in FIG. 1). A valve stem 7 located above the valve 3 engages the ball 4 and extends upwardly through the upper housing member 1 to a location exterior of the upper housing member.

A throttle lever 8 is pivotally mounted on the upper housing member 1 by a pivot pin 10 which permits the lever to be depressed, pushing the valve stem 7 downwardly against the force of the spring 6 to unseat the ball 4 from the valve seat 5 and allowing pressurized air to pass through the valve 3 and into a motor intake duct 9 in the upper housing member. An air motor of the abrading tool comprises a cylinder 12 defining a chamber through which the pressurized air is directed from the intake duct 9. The motor also includes a rotor 11 having an output shaft 13 extending longitudinally through the cylinder 12 and mounted, at locations outside the cylinder by bearings 14 mounted on the upper housing member 1 so that the shaft is free to rotate about its longitudinal axis. The rotor 11 further includes vanes 15 formed on the output shaft 13 and disposed within the cylinder 12. Pressurized air from the intake duct 9 enters the cylinder 12 and impinges upon the vanes 15 causing the output shaft 13 to be rotated at high speed. Air leaving the cylinder 12 is exhausted into an outlet duct 16 in the upper housing member 1 for passage out of the tool.

Figure 2:
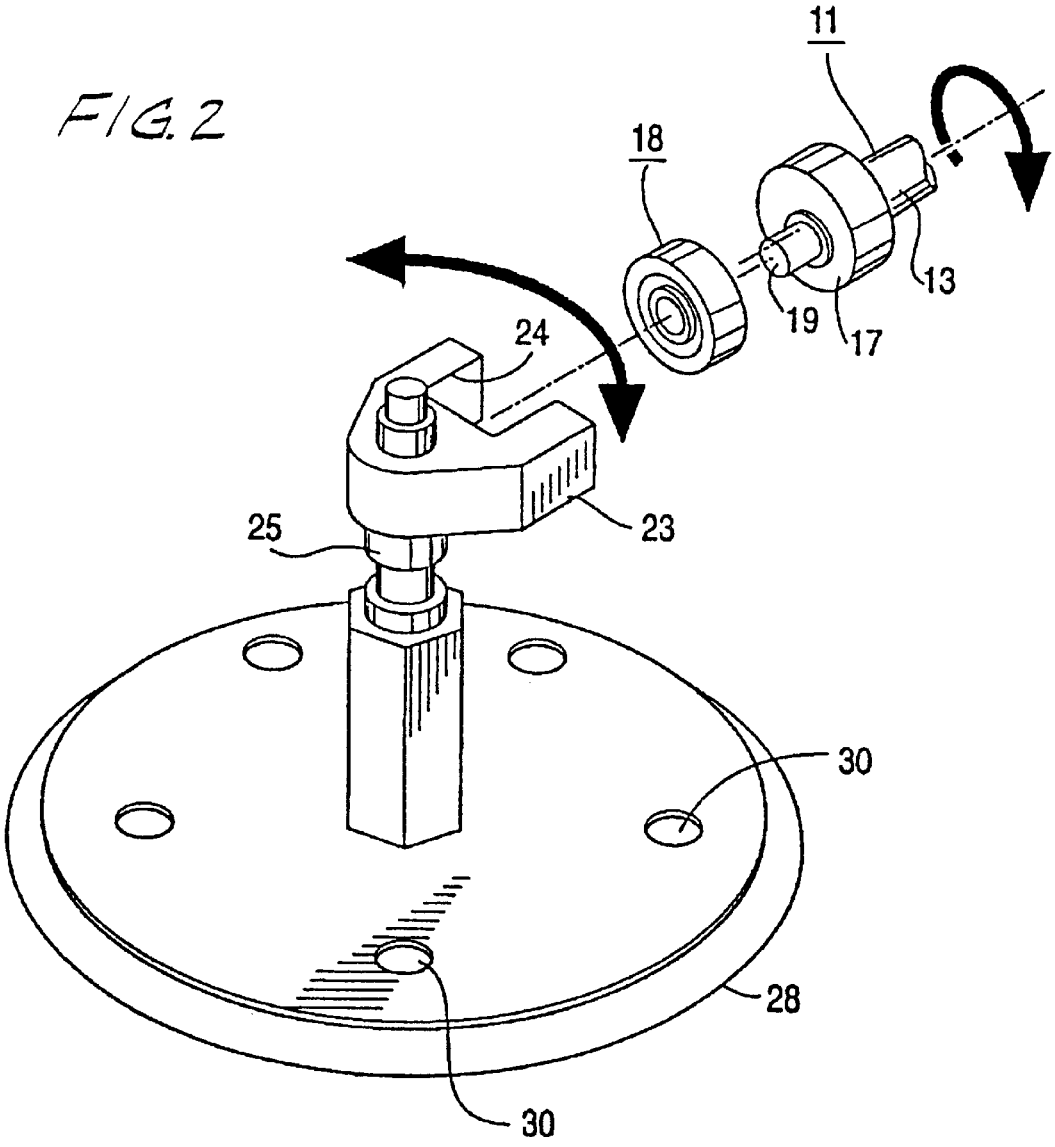
FIG. 2 is an exploded perspective view of a cam unit, cam follower, spindle and abrading pad of the abrading tool.
Figure 4:
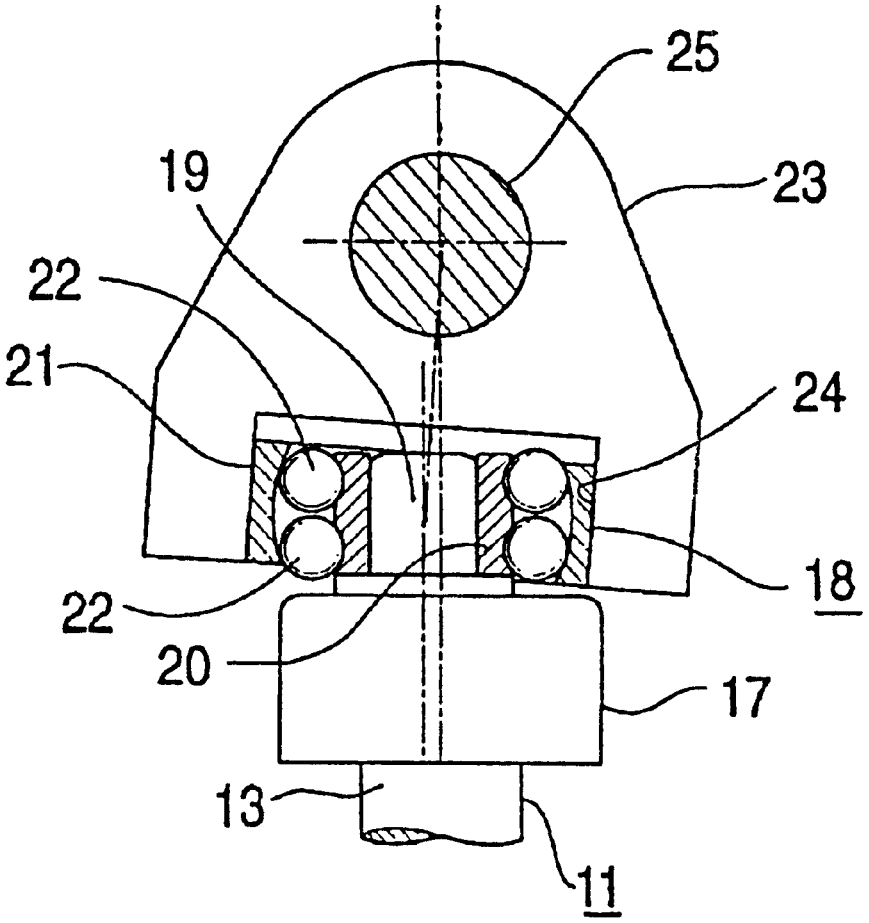
FIG. 4 is the fragmentary, transverse section of FIG. 3, but showing the cam unit rotated to a position in which the axis of the eccentric finger is located to the left of the longitudinal axis of the spindle.
Figure 5:
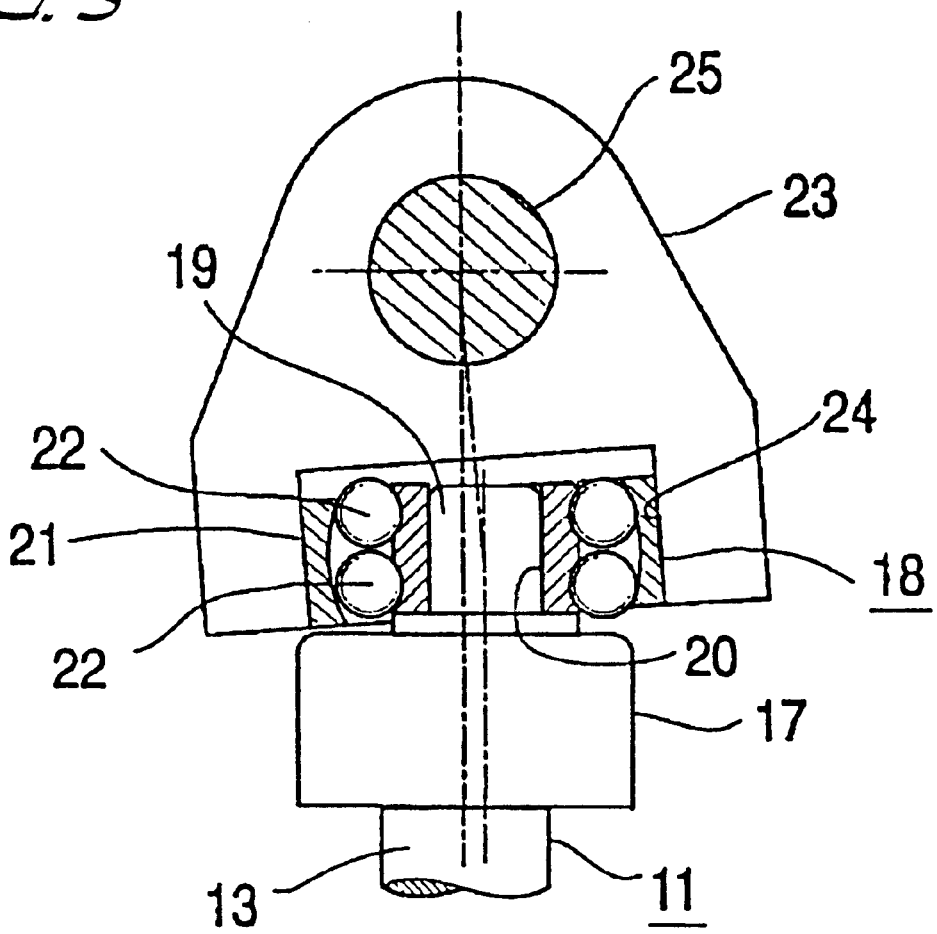
FIG. 5 is the fragmentary, transverse section of FIG. 3, but showing the cam unit rotated to a position in which the axis of the eccentric finger is located to the right of the longitudinal axis of the spindle.

A cam unit, generally indicated at 17, is mounted on the left end (as seen in FIG. 1) of the output shaft 13 for rotation with the shaft. Referring now also to FIG. 2, the cam unit includes a finger 19 which is located eccentrically of the longitudinal axis of the output shaft 13 and protrudes axially outwardly from the cam unit 17 and output shaft. The eccentric location of the finger 19 causes the finger to orbit the longitudinal axis of the output shaft 13 in the manner of a cam when the output shaft rotates. As may be seen in FIG. 3, the cam unit 17 further includes a self-aligning bearing 18 having an annular inner race defining member 20, an annular outer race defining member 21 and ball bearings 22 disposed in races defined by the inner and outer members which permit rotation of the inner race defining member relative to the outer race defining member. The inner surface of the outer race defining member 21 is concave in cross section. Therefore in addition to being able to rotate with respect to the outer member 21, the inner member 20 can pivot within the outer member about the center of the bearing 18, as illustrated in FIGS. 4 and 5.

A cam follower 23 has a flat, generally square C shape defining a recess 24 which receives the self-aligning bearing 18 and the finger 19 of the cam unit 17. The finger 19 is received in and engages the inner race defining member 20 and the outer race defining member contacts the cam follower in the recess 24. As the finger 19 moves from side to side and the cam follower 23 oscillates back and forth (as viewed in FIGS. 3–5), the inner and outer members 20, 21 pivot with respect to each other. As a result, the bearing 18 never loses contact with the finger 19 or the cam follower 23. The surface area of engagement between the finger 19 and the inner surface of the inner member 20, and the surface area of engagement between the outer member 21 and the cam follower 23 remains the same. Because there is no disengagement and re-engagement between the cam unit 17 and the cam follower 23, there is very little vibration or noise generated by the cam unit and cam follower in operation of the abrading tool.

The cam follower 23 is attached to a spindle 25, such as by a shrink fit or other suitable joining, for conjoint rotation with the spindle about the longitudinal axis of the spindle. The spindle 25 passes through a hole 26 in the cam follower 23 and is mounted at its upper end on the upper housing member 1 by a roller bearing 27. The axis of rotation of the spindle 25 is oriented generally perpendicular to the axis of rotation of the output shaft 13. As shown in FIG. 1, the spindle 25 mounts at its lower end an abrading pad 28 of abrasive material. The pad 28 has a circular shape, but may be elliptical, square, or a shape which is selected to corresponding to the shape of the surface (not shown) to be polished or ground by the abrading tool. The abrading pad 28 has holes 30 extending through the thickness of the pad. As will be described more fully hereinafter, the holes 30 permit particulates from the material being abraded and fine dust from the abrasive material of the pad 28 to be collected.

The abrading pad 28 is attached to the lower end of the spindle 25 by a screw 33 which is received through a hole 32 in the pad and into an opening in the lower end of the spindle. The threads on the screw 33 engage the internal threads 34 of the spindle 25 to securely attach the abrading pad 28 to the spindle for conjoint movement with the spindle. A back surface of the abrading pad 28 is formed with a positioning groove 31 which receives the open lower end of the spindle 25. The positioning groove 31 preferably has a shape complementary to that of the lower end of the spindle 25, which is hexagonal in shape. However, it is contemplated that the lower end of the spindle 25 may have other shapes such as oval.

The housing of the abrading tool further includes a lower housing member 35 located below and attached to the upper housing member 1. The lower housing member 35 has a top 36 having a hole 37 through which the spindle 25 extends. The top 36 mounts a bearing 38 which attaches the spindle 25 to the lower housing member while permitting rotation of the spindle about its longitudinal axis relative to the lower housing member. The housing also includes a skirt 40 mounted on the lower periphery of the lower housing member 35 and projecting radially outwardly from the lower housing member. The skirt 40 is preferably made from a flexible, resilient material, such as polyurethane rubber and surrounds the abrading pad 28, preventing the pad from contacting objects adjacent to the surface being abraded. Moreover if the skirt 40 inadvertently comes into contact with the surface being abraded, it will flex and not mark the surface.

The lower housing member 35 generally has the shape of an inverted bowl and defines a chamber 41 over the abrading pad 28. An exhaust duct 42 formed in the lower housing member at the rear of the abrading tool is in fluid communication with the outlet duct 16 and is connected to a hose 43. It is to be understood that in the illustrated embodiment, all of the air passages in the tool (e.g., intake 2, intake duct 9, outlet duct 16 and exhaust duct 42) constitute "passaging means". The chamber 41 of the lower housing member 35 communicates by way of an aperture 45 in the lower housing member with the exhaust duct 42. Air leaving the cylinder 12 of the motor passes out through the outlet duct 16, through opening 46 into the exhaust duct 42 and out of the tool through the hose 43. The air passes at high velocity from the opening 46 of the outlet duct 16 to the exhaust duct 42 over aperture 45 in communication with the chamber 41. The high velocity air flow aspirates air from the chamber 41 through the aperture 45 creating a vacuum pressure (i.e., air pressure below atmospheric) in the chamber.

Particulates and dust generated in operation of the abrading tool are sucked into the chamber 41 through the openings 30 in the abrading pad. In addition, there is an annular space 47 between the abrading pad 28 and the skirt 40 providing fluid communication between the chamber 41 and the periphery of the abrading pad. Thus, particulates and dust may also be drawn into the chamber 41 from the periphery of the abrading pad 28 through the space 47. The particulates and dust are then drawn through the aperture 45 into the flow of air exiting the tool through the exhaust duct 42 into the hose 43. The particulates and dust can then be collected in a container or filter (not shown) downstream of the tool so that they do not become airborne and create a health hazard.

In use, an operator takes the abrading tool in his hand and depresses the throttle lever 8, causing the valve stem 7 to move downwardly into the upper housing member 1. The valve stem 7 pushes against the ball 4 and unseats it from the valve seat 5 against the force of the spring 6. Pressurized air from the intake flows through the valve 3 and intake duct 9 into the cylinder 12 of the motor where the air impinges upon the vanes 15 of the output shaft 13 causing the output shaft to rotate. Rotation of the output shaft 13 causes the cam unit 17 to rotate and the eccentric finger 19 to orbit the axis of rotation of the output shaft. The motion of the finger 19 is transmitted to the cam follower 23 by way of the self-aligning bearing 18, causing the cam follower and spindle 25 on which it is mounted to oscillate about the longitudinal axis of the spindle.

Figure 3:
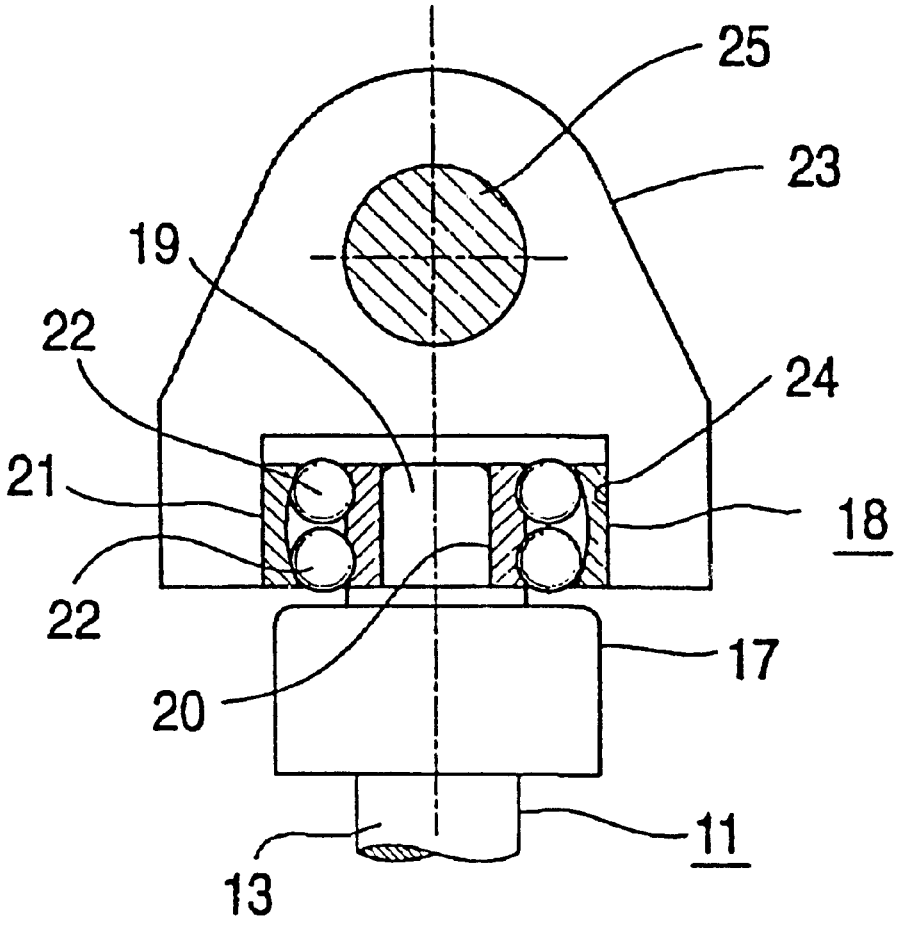
FIG. 3 is a fragmentary, transverse section through the spindle looking down on the cam follower and cam unit as assembled with the spindle in the tool, and showing the cam unit in a position with the longitudinal axis of an eccentric finger of the cam unit intersecting the longitudinal axis of the spindle.

As shown in FIG. 3, when the finger 19 is in its uppermost or lowermost position (i.e., when the axis of the finger lies in a plane defined by the longitudinal axes of the output shaft 13 and the spindle 25) the side of the finger are parallel to opposed side surfaces defining the recess 24 in which the finger is received. This is the position of the finger 19 which is illustrated in FIG. 3. However, when the finger 19 is disposed in its orbit to the left of the plane, as shown in FIG. 4, the cam follower 23 is turned clockwise about the longitudinal axis of the spindle 25 from the position shown in FIG. 3. The finger 19 now lies at an angle relative to the opposed sides of the recess 24. When the finger 19 is disposed in its orbit to the right of the plane, as shown in FIG. 5, the cam follower 23 is turned counterclockwise from its position shown in FIG. 3. The finger again makes an angle with the opposed sides of the recess 24. Thus it will be understood that if the transmission of motion from the output shaft 13 to the spindle 25 depended upon direct contact of the rigid finger 19 with the opposed side of the cam follower recess 24, the surface area of engagement between the finger and the cam follower 23 would continually change as the finger moved in its orbit. The continual disengagement and re-engagement of portions of the finger 19 and cam follower 23 in the recess 24 would lead to substantial vibration and noise in operation.

However, as described previously herein, the finger 19 is interconnected with the cam follower by self-aligning bearing 18. The finger 19 is engaged in the inner race defining member 20 and the cam follower 23 is engaged by the outer race defining member 21. As the cam follower pivots clockwise from the position shown in FIG. 3 to the position shown in FIG. 4, the inner and outer members 20, 21 pivot to keep the center of the inner member aligned with the axis of the finger while maintaining a constant surface area of engagement between the outer member and the opposed sides of the cam follower recess 24. As a result, the cam unit 17 and cam follower 23 operate to produce smooth oscillating motion of the spindle 25 and the abrading pad 28 attached to the spindle while inhibiting vibration and noise. No complicated linkage of gears and gear racks is required to product the oscillating motion of the abrading tool of the present invention. Durability of the abrading tool is superior to those having such linkages to produce reciprocating motion. No high precision machining of the parts transmitting power from the motor to the spindle 25 is required. Thus, the cost of the tool is reduced. Moreover, The oscillating motion of the abrading pad 28 through an arc less than 360° for abrading a surface produces an excellent finish on the abraded surface without leaving marks on the surface such as occurs when an abrading pad is rotated in one direction.

As the abrading pad 28 turns back and forth about the longitudinal axis of the spindle 25 and engages the surfaced to be abraded, particles from the surface are generated. In addition, a fine dust of abrasive material from the abrading pad 28 is also produced. The passage of high velocity air from the outlet duct 16 to the exhaust duct 42 over the aperture 45 aspirates the chamber 41 creating a vacuum pressure in the chamber. Thus, the particulates and dust are drawn through the openings 30 in the abrading pad 28, and from the periphery of the abrading pad through the space 47 between the skirt 40 and the pad, into the chamber 41. From the chamber, the particulates and dust are drawn through the aperture 45 and into the flow of air in the exhaust duct 42 passing into the hose 43. The particulates and dust may then be safely collected without becoming airborne and causing a health hazard.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An abrading apparatus comprising a housing, a valve in the housing adapted for connection to a source of pressurized air; a rotor disposed in the housing downstream of the valve to rotate under the force of pressurized air; an output shaft extending from the rotor; an eccentric cam on the output shaft; a connecting rod having a flat square C shape defining a recess which receives the periphery of the cam therein; a self-aligning bearing on the eccentric cam and engaging the connecting rod in the recess; a spindle affixed to the connecting rod and rotatably mounted on the housing of the apparatus; an abrading pad attached to a lower end of the spindle and having a plurality of apertures through its thickness for passage of particulates and dust through the abrading pad; the housing including a lower housing member covering the upper surface of the abrading pad and forming an vacuum chamber communicating with the apertures in the abrading pad; an exhaust duct connected to one side of the lower housing member and communicating with the vacuum chamber; and an exhaust opening for pressurized air exhausted from the rotor, the exhaust opening in the vacuum chamber and facing toward the exhaust duct.

2. A pneumatic abrading tool for actuating an abrading pad, the tool comprising a housing, a motor disposed in the housing and including an output shaft mounted for rotation about its longitudinal axis, a spindle supported by the housing for turning about its longitudinal axis, the spindle being constructed for mounting the abrading pad thereon for conjoint movement with the spindle, a valve, a connector on the housing adapted for connection to a source of pressurized air, and passaging means in the housing for communication of pressurized air from the connector through the valve to the motor, the motor comprising a rotor having vanes mounted on the output shaft for rotation of the shaft upon actuation of the valve to admit air into the motor, said passaging means including an exhaust duct for receiving air exhausted from the motor, the housing comprising an upper housing member containing the motor and a lower housing member having a generally inverted bowl shape and defining a vacuum chamber over the abrading pad when mounted on the spindle, the exhaust duct extending through the lower housing member and being in fluid communication with the vacuum chamber, said passaging means further including an outlet duct extending generally from the upper housing member into the lower housing member and directed laterally in the lower housing member for delivering exhaust air into the exhaust duct within the lower housing member thereby to provide a vacuum force in close proximity to the abrading pad for drawing dust into the vacuum chamber and thence out through the exhaust duct.

3. A pneumatic abrading tool as set forth in claim 2 wherein the housing further comprises a skirt of resilient material extending from the lower housing member and shaped to surround the abrading pad when mounted on the tool.

4. A pneumatic abrading tool as set forth in claim 3 in combination with the abrading pad mounted on the spindle, the abrading pad having a abrading surface and at least one opening from the abrading surface completely through the pad and in fluid communication with the vacuum chamber for passage of dust generated by the abrading pad through the opening and into the vacuum chamber, and wherein the skirt and abrading pad define a generally annular space therebetween in fluid communication with the vacuum chamber for passage of dust adjacent to the periphery of the abrading pad into the vacuum chamber.

5. A pneumatic abrading tool as set forth in claim 2 further comprising a cam unit connected to the output shaft for rotation with the output shaft, the cam unit being eccentric of the output shaft for orbiting the output shaft upon rotation of the output shaft, and a cam follower mounted on the spindle for conjoint movement therewith and engaging the cam unit whereby upon rotation of the output shaft the cam follower oscillates through an angle less than 360° about the longitudinal axis of the spindle and the spindle turns back and forth about its axis through the same angle.

6. A pneumatic abrading tool as set forth in claim 5 wherein the longitudinal axis of the motor output shaft is non-parallel to the longitudinal axis of the spindle.

7. A pneumatic abrading tool as set forth in claim 6 wherein the cam unit is constructed to maintain the same surface area of engagement with the cam follower as the cam unit orbits and the cam follower oscillates through said angle for reducing noise and vibration.

8. A pneumatic abrading tool as set forth in claim 7 wherein the cam follower has a recess for receiving a portion of the cam unit therein, and wherein the cam unit comprises a finger disposed eccentrically of the motor output shaft axis for orbiting the axis upon rotation of the output shaft, the finger being received in the recess, and a self-aligning bearing in the recess engaging the finger and the cam follower for interconnecting the cam unit and cam follower, the self-aligning bearing permitting relative pivoting motion between the finger and the cam follower in the recess.

9. A pneumatic abrading tool as set forth in claim 8 wherein the self-aligning bearing comprises an outer race defining member engaging the cam follower in the recess over a fixed surface area, an inner race defining member engaging the finger over a fixed surface area, the inner and outer race defining members defining a race between them, and ball bearing disposed in the race and permitting pivoting movement between the inner and outer race defining members.

10. A pneumatic abrading tool as set forth in claim 5 in combination with the abrading pad.

* * * * *